US008028765B2

(12) United States Patent
Plazas

(10) Patent No.: US 8,028,765 B2
(45) Date of Patent: Oct. 4, 2011

(54) DRILL BIT, DRILLING SYSTEM, AND RELATED METHODS

(75) Inventor: Gabriel Dario Carrillo Plazas, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 97 days.

(21) Appl. No.: 12/428,927

(22) Filed: Apr. 23, 2009

(65) Prior Publication Data

US 2009/0283325 A1 Nov. 19, 2009

Related U.S. Application Data

(60) Provisional application No. 61/047,322, filed on Apr. 23, 2008.

(51) Int. Cl.
*E21B 10/60* (2006.01)

(52) U.S. Cl. ..... 175/57; 175/327; 175/393

(58) Field of Classification Search ..... 175/400, 175/429, 418, 57, 65, 327, 393, 424
See application file for complete search history.

(56) References Cited

U.S. PATENT DOCUMENTS

| | | | | |
|---|---|---|---|---|
| 4,303,136 | A | 12/1981 | Ball | |
| 4,515,227 | A | 5/1985 | Cerkovnik | |
| 4,606,418 | A | 8/1986 | Thompson | |
| 4,640,374 | A | 2/1987 | Dennis | |
| 4,676,324 | A * | 6/1987 | Barr et al. | 175/393 |
| 4,719,979 | A * | 1/1988 | Jones | 175/430 |
| 4,727,946 | A | 3/1988 | Barr et al. | |
| 4,785,885 | A * | 11/1988 | Cherrington et al. | 166/285 |
| 5,316,095 | A | 5/1994 | Tibbitts | |
| 6,834,733 | B1 * | 12/2004 | Maouche et al. | 175/378 |
| 7,472,764 | B2 | 1/2009 | Zahradnik et al. | |
| 2009/0145663 | A1 * | 6/2009 | Durairajan et al. | 175/57 |

FOREIGN PATENT DOCUMENTS

EP 0 291 193 A1 11/1988

OTHER PUBLICATIONS

International Search Report, PCT/US2009/041495, dated Aug. 4, 2009.

* cited by examiner

*Primary Examiner* — David Andrews
(74) *Attorney, Agent, or Firm* — Bracewell & Giuliani, LLC

(57) ABSTRACT

A rotary drag bit for use in subterranean earth boring operations, the drag bit having blades, rows of cutters on the blades, and nozzles disposed within the rows. The nozzles are configured to discharge fluid during drilling.

20 Claims, 3 Drawing Sheets

DRILL BIT, DRILLING SYSTEM, AND RELATED METHODS

CROSS REFERENCE TO RELATED APPLICATIONS

This application claims priority to and the benefit of co-pending U.S. Provisional Application Ser. No. 61/047,322, filed Apr. 23, 2008, the full disclosure of which is hereby incorporated by reference herein.

BACKGROUND OF THE INVENTION

1. Field of the Invention

The present invention relates to a device used for boring a subterranean wellbore. More specifically, the invention relates to a rotary drag bit having blades with recesses and nozzles in the recesses.

2. Description of the Related Art

Drill bits used for creating subterranean wellbores typically comprise one of a rotary tri-cone drill bit or a drag bit. Drag bits are typically comprised of a single body molded from a combination of tungsten carbide with a steel core. The body includes raised portions referred to as blades that mm along the face of the bit body. The blades have recesses formed thereon extending generally perpendicular to the blade. The inserts or cutters are anchored within the recesses generally by welding, braising, or some other fastening means. Additionally, fluid nozzles are generally provided along the bit base for injecting fluid while drilling to wash away cuttings formed during the drilling process, as well as for cooling the drill bit.

Drill bits are typically connected to the end of a drill string where the upper end of the drill string is coupled with a drive means for rotating the string, thus, rotatingly operating the drill bit during drilling operations. The drill bit cuts through the subterranean formation by fracturing and/or shearing the rock formation. The drilling fluid or mud is pumped through the drill string down through the bit to perform the previously mentioned cleaning and cooling functions. Additionally, the inserts may include a polycrystalline diamond compact (PDC) on the bit face. Thus, drag bits having a PDC insert are referred to as PDC bits. PDC bits are generally employed in formations classified as having a soft to medium hardness. Several parameters determine drill bit performance, such as mud type, revolutions per minute, weight on bit, drill string, and the formation. The performance of the bit is evaluated as a rate of penetration.

One characteristic of a PDC drill bit is its stability, which reduces the magnitude of vibration at the bottom hole assembly. When the rotational axis is offset of the geometrical center of the bit, a "whirling" effect is produced which overloads the amount of cuttings in the wellbore. The PDC blade shape, hydraulics, and density/size of the cutters affect bit performance. Standard PDC bits are characterized by an inclusion of several blades, each consisting of a solid piece of material extending from the bit face. These bits can sometimes experience a phenomenon referred to as "balling", which refers to the collection of soft formation on the bit face. The soft formation collected on the bit face reduces the cutting contact therefore decreasing bit performance. The "balling" requires cleaning of the bit which may consume a considerable time of rig time for pumping and/or a bit trip.

SUMMARY OF THE INVENTION

Accordingly, a need has arisen for a fixed or drag bit used in conjunction with earth boring operations that can avoid bit balling. In accordance with the present invention an earth boring bit is disclosed comprising a bit body having sides and a bit face, an elongated blade having advancing and retreating lateral opposing sides extending upward from the bit face and terminating at a blade surface, a recess in the blade surface intersected by the row of cutters, positioned between a pair of the cutters within the row, and extending between the advancing and retreating lateral sides to form a slot extending therebetween, and a fluid nozzle having a fluid discharge directed away from the bit face. The nozzle may be on a blade surface, on the bit face, or in a recess formed into the bit body, the recess having sides and a base and the nozzle being provided on the base. In one optional embodiment the earth boring bit includes elongated undulations formed into the bit body. The undulations having sides and a base and a nozzle being provided on the base. Cutters may optionally be included on the undulation sides. The nozzle may include a nozzle inlet connected to a fluid passage formed through the bit body. Nozzles may also be included on the bit face.

Also disclosed herein is a drilling system comprising, a drill string having a top and a bottom, a top drive coupled to the drill string top, and a drill bit affixed on the drill string bottom. In one embodiment, the drill bit includes a body with a bit face, a blade on the bit face having sides extending from the bit face, a blade surface connecting the upper terminal side ends, and a recess on the blade surface intersected by the row of cutters, positioned between a pair of the cutters within the row, and having portions extending between advancing and retreating lateral sides of the bit blade to form a slot extending therebetween. The blade surface can be perpendicular to the sides. The bit also may include cutters arranged in rows on the blade surface, and a nozzle having a discharge directed away from the bit face. The drilling system also includes a drilling fluid supply in fluid communication with the drill string.

Also disclosed herein is a method of boring a subterranean wellbore through a formation comprising rotating a bit having a cutting surface, a raised blade on the cutting surface, a row of cutters on an upper surface of the blade oriented to face the direction of rotation, a recess inline and intersected by with the row of cutters and having portions extending between advancing and retreating lateral sides of the raised blade to form a slot extending therebetween, and a fluid nozzle in the recess. The open portion of the bit face forming the slot can advantageously increase junk slot area and to increase the cooling effect provided by added drilling fluid and reduce resistive torque of the raised blade to thereby enhance bit rate of penetration. The method also includes contacting the rotating bit with the formation to engage the cutters with the formation and remove formation material, and discharging a drilling fluid stream from within the recess and directing the stream to the formation.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present disclosure includes a drag bit having a body with a bit face, blades on the bit face, recesses in the blades, and at least one nozzle disposed in the recess. Optionally, additional nozzles can be disposed on the bit body and away from the blades. In an embodiment of the drag bit, a portion of the cutting bit face is removed which increases the junk slot area. This correspondingly increases the cooling effect provided by any added drilling fluid and also reduces the resistive torque of the blade. Reducing the resistive torque and enhancing cooling boosts the bit rate of penetration (ROP).

Figure 1:
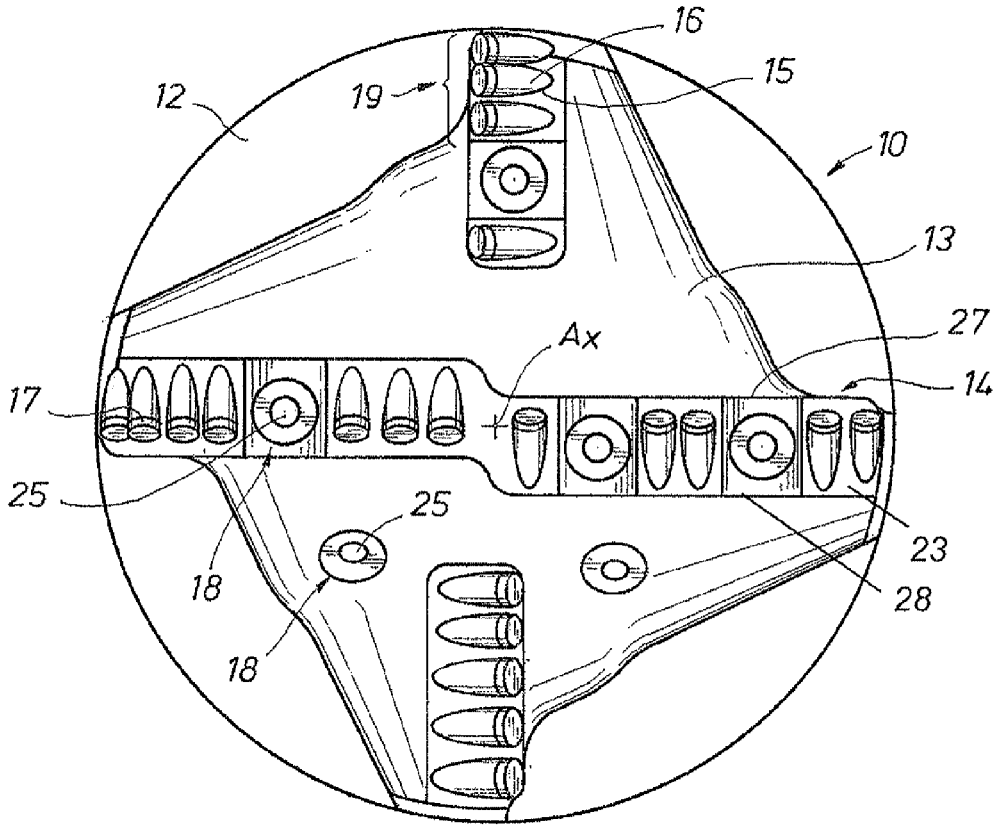
FIG. 1 illustrates an upward looking view of a drill bit embodiment in accordance with the present disclosure.

With reference now to FIG. 1 an upward-looking view of a drill bit 10 embodiment is illustrated in accordance with the present disclosure. The bit 10 comprises a molded body 12 having a bit face 13 on its upper surface. Blades 14 are shown on the bit face 13 being generally rectangular raised portions extending between the body axis $A_X$ and the body 12 outer radius. The blades 14 have advancing and retreating lateral sides 27, 28 extending upward from the bit face 13 and terminating at a blade surface 23 shown substantially perpendicular to the blade sides 27, 28. The scope of the present disclosure includes other blade 14 embodiments, such as for example blades 14 not aligned with the axis $A_X$. Cutters 16 are shown attached on the blade surface 23. The cutters 16 are elongated frusto-conically shaped solid members secured within pockets 15 formed into the blade surface 23. The pockets 15 and cutters 16 are aligned generally perpendicular to the blade 14 elongate section. The forward or cutting end of the cutters 16 includes a disc-like PDC insert 17. The hardened structural material of the PDC insert enhances operation of the bit 10 during cutting operations.

The cutters 16 are shown aligned parallel and arranged in rows 19 along the blade 14. Nozzles 18 are illustrated periodically disposed within these rows 19 of cutters 16 and in line with the rows 19. In addition to being in line with the rows 19, the nozzles 18 have a discharge 25 directed between adjacent rows 19 and into the open space between these rows 19. Optionally, nozzles 18 may also be disposed on the bit face 13. As noted above, placement of the nozzles 18 within the rows 19 increases cooling during drilling. This nozzle 18 placement also increases the junk slot space allowing more formation cuttings to flow past the bit 10 and reduces rotational torque on the drill bit 10 with the removal of the cutters 16.

Figure 2:
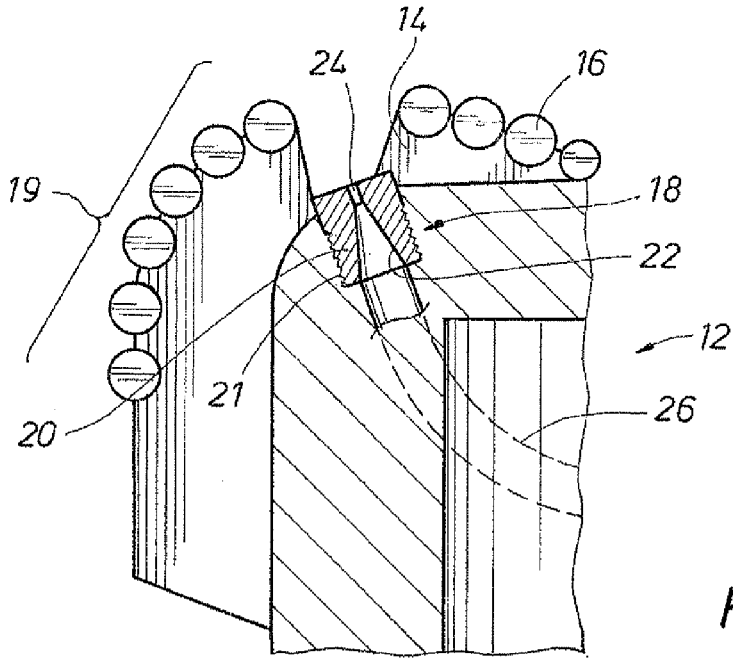
FIG. 2 depicts a side partial sectional view of a portion of a drill bit in accordance with the present disclosure.

With reference to FIG. 2, a side cross-sectional view of an embodiment of a bit body 12 is illustrated. As shown, a nozzle 18 is inserted within the body 12 between adjacent rows 19 of cutters 16. In further detail, the nozzle 18 is formed from a housing 20 screwed into the bit body 12 with threads 21 at the base of the housing 20. A frusto-conical annulus 22 is formed through the housing providing fluid communication from the housing 20 bottom end to the apex of the frusto-conical annulus 22. At the apex of the annulus 22, a nozzle exit 24 is formed up to the housing 20 upper end. Thus, fluid communication extends through the nozzle 18 via the annulus 22 and the nozzle exit 24. Shown in dashed outline is a fluid passage 26 extending through the bit body 12 to the housing 20 bottom end. The fluid passage 26 is in fluid communication with a drill string (not shown) through which drilling fluid is supplied to the nozzle 18.

Figure 3:
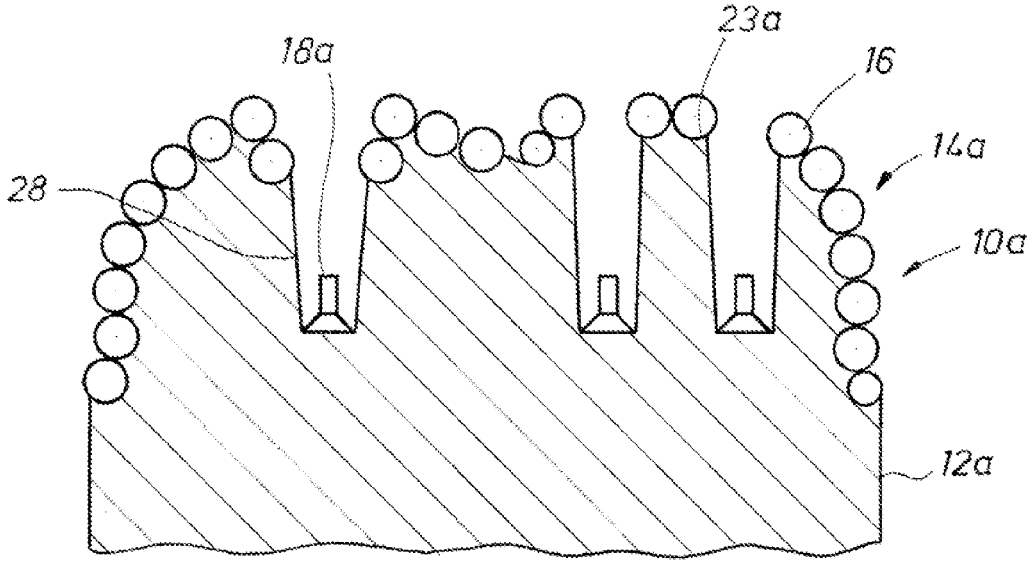
FIG. 3 is a side partial sectional view of a portion of a drill bit in accordance with the present disclosure.

An optional embodiment of a drill bit 10*a* is shown in a side partial sectional view in FIG. 3. In this embodiment, the bit 10*a* includes a body 12*a* having a blade 14*a* extending along its upper cutting surface. Cutters 16 are transversely disposed on the blade 14*a* upper surface 23*a*. Recesses 28 are each formed into the bit body 12*a* from the upper surface 23*a* through the blades 14*a* and extend between the advancing and retreating lateral sides of the blade 14*a* to form a slot 28 extending therebetween. Nozzles 18*a* are optionally provided in the base of the recesses 28, wherein the nozzles 18*a* are in fluid communication with drilling fluid as discussed above.

Figure 4:
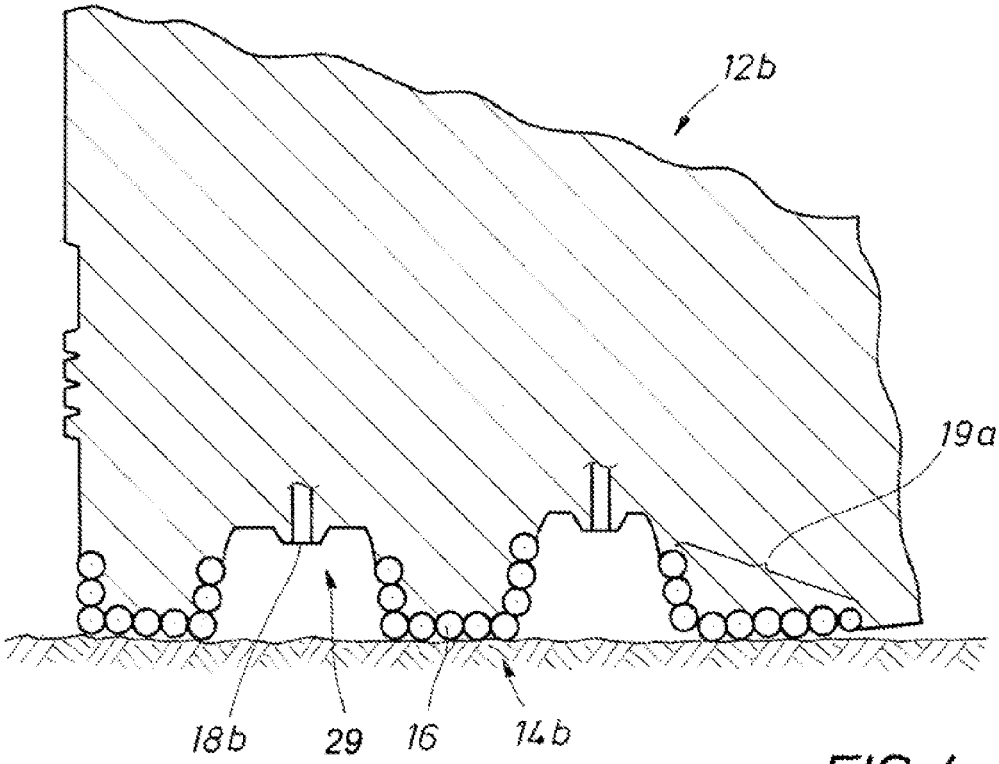
FIG. 4 provides a side partial sectional view of a portion of a drill bit in contact with a formation.

A partial side sectional view of another embodiment of a bit body 12*b* is provided in FIG. 4. In this embodiment, rows 19*a* of cutters 16 are provided on a cutting blade 14*b* formed on the cutting surface of a bit body 12*b*. Extended undulations 29 protrude into the cutting face between adjacent rows 19*a*. The undulations 29 form a widened recess between the rows 19*a*. Unlike the recesses 28 of FIG. 3 which have relatively smooth sides, cutters 16 may be included within the undulations 29. A nozzle 18*b* for supplying drilling fluid to the bit body 12*b* face, is shown on the lower portion or base of the undulations 29.

Figure 5:
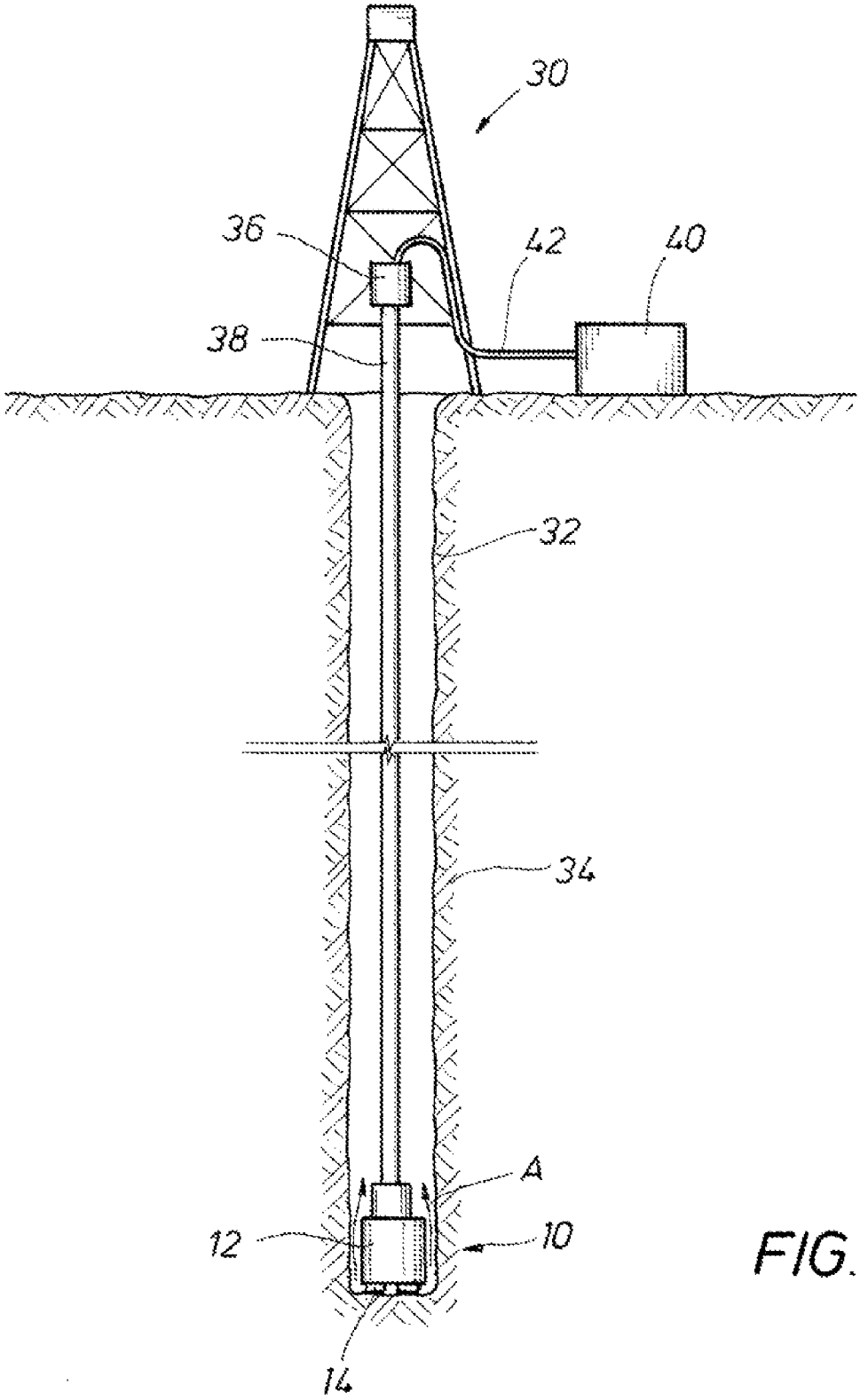
FIG. 5 is a side sectional view of a drilling system employing a drill bit as described herein.

An example of a drilling system 30 employing an embodiment of the bit 10 described herein is schematically illustrated in a side partial sectional view in FIG. 5. The drilling system 30 comprises a drill string 38 connected to a top drive 36 on its upper end, the top drive 36 provides the rotational torque necessary for earth boring operations. The bit 10 is attached to the drill string 32 lower end. Here the system 30 is illustrated boring a wellbore 32 into a subterranean formation 34. Drilling fluid, for use during drilling, is supplied to the system 30 via a fluid line 42 from a fluid reservoir 40. The fluid exits the nozzles and flows back up the wellbore 32, as is illustrated by arrows A.

Thus, by increasing the effective fluid delivery area during drilling, as well as increasing the junk slot flow area, the ability to clean the face of a drill bit during use is greatly enhanced thereby speeding drilling operations significantly. Optionally, cutters 16 may also be provided on the lateral sides of each of the bits described herein in addition to the lower cutting face.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. An earth boring bit comprising:

a bit body, having sides and a bit face;

an elongated blade having advancing and retreating lateral sides projecting from the bit face, a blade upper surface spanning between the respective ends of the blade sides opposite the bit face;

a row of cutters connected to and extending along a length of the blade upper surface;

a recess in the blade upper surface, the recess intersected by the row of cutters, positioned between a pair of the cutters within the row, and extending between the advancing and retreating lateral sides to form a slot extending therebetween;

a fluid nozzle in the recess; and a fluid discharge on the fluid nozzle.

2. The earth boring bit of claim 1, wherein the nozzle is threadingly connected within the recess, portions of the nozzle protruding above a base of the recess.

3. The earth boring bit of claim 1, wherein the nozzle discharge is directed away from the bit face.

4. The earth boring bit of claim 1, wherein the recess extends to the bit face and the fluid nozzle is set in the bit face.

5. The earth boring bit of claim 1, wherein the recess extends into the bit face and the fluid nozzle is set in the recess bottom.

6. The earth boring bit of claim 1, further comprising a nozzle inlet and a fluid passage connected to the nozzle inlet.

7. The earth boring bit of claim 1, wherein the row of the plurality of cutters is a first row of cutters, the earth boring bit further comprising an additional blade on the bit face, the additional bit blade having advancing and retreating lateral sides projecting from the bit face, a blade upper surface spanning between the respective ends of the blade sides opposite the bit face, a second row of cutters on the blade upper surface of the additional blade, and a recess in the additional blade upper surface, the recess intersected by the second row of cutters and extending between the advancing and retreating lateral sides to form a slot extending therebetween.

8. The earth boring bit of claim 1, wherein the recess is a first recess and the pair of cutters is a first pair of cutters, the earth boring bit further comprising a second recess in the blade upper surface, the second recess intersected by the row of cutters and positioned between a second pair of the cutters within the row.

9. The earth boring bit of claim 1, wherein portions of the recess define undulations on the blade upper surface.

10. A drilling system comprising:

a drill string having a top and a bottom;

a top drive coupled to the drill string top;

a drill bit having a body affixed on the drill string bottom;

a bit face on the bit body, a bit blade projecting up from the bit face;

a plurality of cutters arranged in a row on an upper surface of the bit blade;

a recess formed on the bit blade upper surface, the recess intersected by the row of cutter, positioned between a pair of the cutters within the row, and having portions extending between advancing and retreating lateral sides of the bit blade to form a slot extending therebetween;

a nozzle in the recess;

a discharge on the nozzle directed away from the bit face; and a drilling fluid supply in fluid communication with the drill string.

11. The drill system of claim 10, wherein the row of the plurality of cutters is a first row of cutters, the drilling system further comprising an additional bit blade projecting up from the bit face, an upper surface, a second row of cutters on the upper surface of the additional bit late, and a recess formed on the additional bit blade upper surface, the recess intersected by the second row of cutters and having portions extending between advancing and retreating lateral sides of the additional bit blade to form a slot extending therebetween.

12. The drill system of claim 10, wherein the recess is a first recess and the pair of cutters is a first pair of cutters, the drilling system further comprising a second recess in the bit blade upper surface, the second recess intersected by the row of cutters and positioned between a second pair of the cutters within the row.

13. The drill system of claim 10, wherein the recess extends down to the bit face and the nozzle is provided on the bit face.

14. The drill system of claim 10, wherein the recess extends into the bit face, and the nozzle is in the recess bottom.

15. The drill system of claim 10, wherein portions of the recess define undulations on the bit blade.

16. The drill system of claim 15, further comprising cutters on the undulations.

17. The drill system of claim 10, further comprising a nozzle inlet and a fluid passage connected to the nozzle inlet.

18. The drill system of claim 17, wherein the fluid passage is in fluid communication with the drill string.

19. A method of boring a subterranean wellbore through a formation comprising:

rotating a bit having a cutting surface, a raised blade on the cutting surface, a row of cutters on an upper surface of the blade oriented to face the direction of rotation, a recess inline with the row of cutters, portions of the recess extending between advancing and retreating lateral sides of the raised blade to form a slot extending therebetween, and a fluid nozzle in the recess, the recess and nozzle intersected by the row of cutters and positioned between a pair of the cutters within the row;

contacting the rotating bit with the formation to engage the cutters with the formation and remove formation material; and discharging a drilling fluid stream from within the recess and directing the stream to the formation.

20. The method of claim 19, wherein the slot is provided to increase junk slot area and to increase a cooling effect provided by added drilling fluid and reduce resistive torque of the raised blade to thereby enhance bit rate of penetration, the method further comprising attaching the bit to a drill string, rotating the drill string, flowing drilling fluid through the drill string to the bit, and providing the fluid nozzle in the recess in fluid communication with the drill string to provide the added drilling fluid.

* * * * *

UNITED STATES PATENT AND TRADEMARK OFFICE

CERTIFICATE OF CORRECTION

PATENT NO. : 8,028,765 B2
APPLICATION NO. : 12/428927
DATED : October 4, 2011
INVENTOR(S) : Gabriel Dario Carrillo Plazas It is certified that error appears in the above-identified patent and that said Letters Patent is hereby corrected as shown below:

In column 5, line 46, claim 10, delete the word, "cutter," and insert the word --cutters--.

Signed and Sealed this
Thirty-first Day of January, 2012

David J. Kappos

David J. Kappos
*Director of the United States Patent and Trademark Office*